United States Patent [19]

Joseph

[11] 4,399,399

[45] Aug. 16, 1983

[54] PRECISION CURRENT SOURCE

[75] Inventor: Eric D. Joseph, Mesa, Ariz.

[73] Assignee: Motorola, Inc., Schaumburg, Ill.

[21] Appl. No.: 333,211

[22] Filed: Dec. 21, 1981

[51] Int. Cl.[3] ..... G05F 3/20

[52] U.S. Cl. ..... 323/315; 323/316

[58] Field of Search ..... 323/311, 312–316; 307/296 R, 297; 330/252, 257, 288, 307

[56] References Cited

U.S. PATENT DOCUMENTS

| | | | |
|---|---|---|---|
| 3,914,683 | 10/1975 | van de Plassche | 323/316 |
| 3,962,592 | 6/1976 | Thommen et al. | 323/315 |
| 4,217,539 | 8/1980 | Okada | 323/316 |
| 4,292,584 | 9/1981 | Kusakabe | 323/316 |
| 4,350,904 | 9/1982 | Cordell | 307/297 |

*Primary Examiner*—William H. Beha, Jr.
*Attorney, Agent, or Firm*—Michael D. Bingham

[57] ABSTRACT

A circuit for providing an output current the magnitude of which is substantially independent to variations in the power supply voltage applied thereto. The circuit comprises first and second current sourcing transistors, and a conventional $\Delta V_{be}/R$ current mirror circuit for setting the current sourced from the two transistors. At least one output transistor having its base and emitter electrodes coupled in parallel with the base and emitter electrodes of the two transistors is included for sourcing the output current. An operational amplifier having its inverting and non-inverting inputs connected with respective collectors of the two transistors and its output connected to the commonly connected bases of the two transistors and the output transistor is provided which maintains the collectors of the two transistors at equal potential levels even though the magnitude of the power supply voltage may vary so that the current produced at the collector of the output transistor does not vary substantially.

5 Claims, 2 Drawing Figures

PRECISION CURRENT SOURCE

BACKGROUND

1. Field of the Invention

This invention relates to circuits for providing a source of current and, more particularly, to a low-voltage precision current source for providing a current at the output thereof that is substantially independent to variations in the operating potential applied thereto.

2. Description of the Prior Art

The prior art is replete with different types of current source circuits for providing an output current that is a function of some parameter of the circuit. For instance, a basic current source that is well known in the art is the simple current mirror circuit comprising a diode-connected transistor having its emitter and base coupled in parallel with the emitter and base of a second transistor. The commonly connected emitters of each transistor are connected to a source of operating potential with the collector of the diode-connected transistor being coupled to a source of input current. The input current is mirrored through the second transistor wherein the current flowing in the collector thereof is equal in magnitude to the value of the input current. Moreover, as is understood, the value of the collector current flowing in the second transistor can be made any ratio of the input current by area ratioing the emitter areas of the two transistors. The disadvantage of this circuit is that errors are inherent therein which prevents the absolute matching of the output current to the input current. The most significant cause of this error is the base current error associated with the two transistors, especially if these devices are PNP transistors. Additionally, this circuit is subject to errors induced by power supply ripple variations due to finite output impedance.

Other prior art current sources reduce the errors associated with the PNP base current flow but suffer in that higher compliance voltages are required. Compliance voltage is defined as the voltage drop required to be developed across the current source in order to provide a current at the output thereof. Thus, for example, a prior art circuit which is a modification of the above described circuit, and which provides good current matching between the input and output currents, is generally known in the art as the "Wilson" type current source. Although reducing base current errors, the aforementiond circuit requires a minimum compliance voltage equal to a $V_{be}$ drop plus the voltage drop across the collector-to-emitter of a transistor operated in a saturated condition, where $V_{be}$ is the voltage drop across the base-to-emitter of the transistor. Thus, there are some applications, for example, where low operating potentials are required in conjunction with a requirement for maximum desired load voltages. This application would not allow such a current source to be utilized since the compliance voltage drop would prevent operation of the load circuit coupled thereto.

Thus, there is a need for a low-voltage precision current source suitable to be fabricated in monolithic integrated circuit form that provides an output current the magnitude of which is determined by a known and constant parameter of the current source and which is independent to ripple variations in the supplied power supply voltage.

Additionally, the need arises for such a current source which has reduced beta current error to therefore provide a good match between the input and output currents.

Additionally, the precision current source would require a minimum compliance voltage of only one $V_{ce}$(sat).

SUMMARY OF THE INVENTION

Accordingly, it is an object of the present invention to provide an improved current source.

It is another object of the present invention to provide an improved current source suitable to be manufactured in integrated circuit form.

Still another object of the present invention is to provide a current source having a low compliance voltage and good matching between the input current and the output current.

A further object of the present invention is to provide a current source the value of the output current provided therefrom being determined by substantially one parameter of the current source which is independent to power supply voltage ripple variations.

In accordance with the above and other objects there is provided a precision current source circuit comprising a two-transistor $\Delta V_{be}/R$ current drive network wherein the ratio of current densities flowing therethrough is controllable to a predetermined value by means of a feedback circuit having respective inputs coupled to each transistor respectively. A pair of current sourcing transistors, coupled in parallel configuration with respect to each other and having an output electrode connected to a respective one of the two transistors, provide the current flow through the current drive network. The output of the feedback circuit is connected to the commonly connected control electrodes of the pair of current sourcing transistors wherein the voltage levels appearing at the respective output electrodes of the pair of transistors are made equal and substantially independent to power supply voltage ripple variations. The power supply voltage is applied to the pair of transistors at respective main electrodes thereof. At least one output transistor is included having a main electrode and control electrode coupled to the main electrodes and control electrodes of the pair of transistors respectively. The other main or output electrode of the output transistor is connected to an output of the current source for producing a current thereat having a magnitude which is a function of the ratio of the current densities flowing through the pair of transistors and which is, therefore, independent to power supply ripple variations.

It is one feature of the invention that the compliance voltage, the voltage potential drop between the applied power supply voltage and the output of the current source, is minimal; being equal to the voltage drop between the two main electrodes of the output transistor. Thus, the current source provides a precision current having a value which is determined by one parameter of the circuit which is substantially independent of variations in the operating potential supplied thereto while needing a minimal compliance voltage such that the current source is capable of working even with low supply voltages applied thereto.

DETAILED DESCRIPTION OF THE PREFERRED EMBODIMENT

Figure 1:
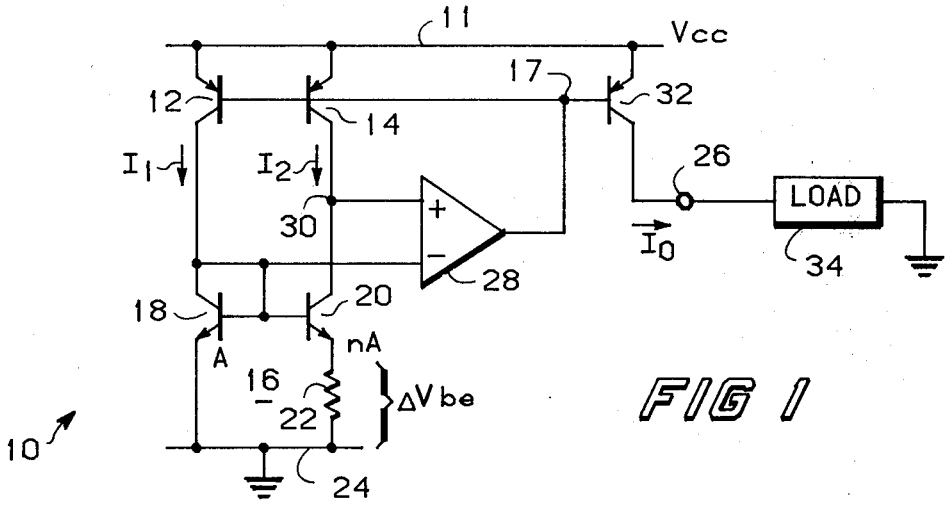
FIG. 1 is a partial schematic and block diagram illustrating the precision current source of the present invention.

Turning to FIG. 1 there is illustrated low-voltage precision current source 10 of the present invention in simplified form, it is understood that the current source 10 is suited to be manufactured in integrated circuit form and could form a portion of a more complex integrated circuit. As illustrated, an operating input potential $V_{cc}$ is supplied to current source 10 at power supply conductor 11. A pair of current sourcing PNP transistors 12 and 14 source currents I1 and I2 from the collectors thereof respectively to a $\Delta V_{be}/R$ type current drive source circuit 16. The emitter electrodes of transistors 12 and 14 are coupled to conductor 11 and the base electrodes to node 17.

$\Delta V_{be}/R$ current mirror drive source 16 is well known in the art and comprises diode connected NPN transistor 18 and NPN transistor 20. The collector of transistor 18 is directly connected with the base thereof to the collector of transistor 12 and the base of transistor 20. The emitters of transistors 18 and 20 are returned directly and through resistor 22 respectively to conductor 24 which is supplied a ground reference potential. The collector of transistor 20 is coupled to the collector of transistor 14. As understood, a voltage $V_{be}$, equal to the base-emitter voltage drop of a transistor, is developed across transistor 18 in response to the current I1 that is sourced through this transistor's collector-emitter path. As illustrated, the emittor area of transistor 20 is N times the emitter area of transistor 18 with these two transistors being operated at different current densities such that a voltage is produced across resistor 22 which is proportional to the difference in the two transistors base-two emitter voltages. Thus, a $\Delta V_{be}$ voltage is developed across resistor 22.

As discussed above, transistors 12 and 14 may have ratioed emitter areas whereby collector currents flowing therethrough may be unequal. For explanation purposes, however, it may be assumed that current I1 and I2 are made equal in value such that the voltage developed across resistor 22 is equal to:

$$VR_{22} = \frac{kT}{q} \ln \frac{NI_1}{I_2} \quad (1)$$

If I1 is equal to I2, the voltage across resistor 22 would be constant for a given ambient temperature such that the current flowing through resistor 22 is also made constant.

An object of the present invention is to provide a current I0, at the output 26 of current source 10 which is known and which is not dependent on the value of the applied input voltage $V_{cc}$. If, then, the current I0 is made proportional only to the value of the current flowing through resistor 22, ripple variations in the supply voltage $V_{cc}$ will not cause variations in the magnitude of the current I0. The current through resistor 22 can be made substantially constant by making the voltage potentials appearing at the respective collectors of transistors 12 and 14 equal and independent to the value of $V_{cc}$.

Feedback circuitry comprising operational amplifier 28 is provided to force equal voltage potentials at the collectors of transistors 12 and 14. Additionally, feedback circuit 28 causes the voltage level appearing at node 30 to be level shifted down to a low value: equal to a $V_{be}$ voltage drop above ground reference. As shown, operational amplifier 28 has an inverting input coupled to the base and collector of transistor 18 and a noninverting input coupled to the collector of transistors 14 and 20. The output of the operational amplifier 28 coupled to node 17. Ideally, no currents flow into the inputs of the operational amplifier and the voltage differential therebetween is zero. Because the voltage drop across the base-emitter of transistor 18 is equal to $V_{be}$, the inverting input of operational amplifier 28 will be at this level which forces the potential at node 30 to be at an equal potential value. Thus, even though the value of the voltage $V_{cc}$ may vary within a predetermined range, the voltage potentials at the collectors of transistors 12 and 14 remain constant and equal to the value $V_{be}$. Hence, the current through resistor 22 remains constant.

An output PNP transistor 32 is provided with its base and emitter electrodes connected between the base and emitter electrodes respectively of transistors 12 and 14. The collector of transistor 32 is coupled to output terminal 26 to source the current I0 to load 34. By matching transistor 32 to transistors 12 and 14, the current I0 is made to be equal to the collector currents $I_1$ and $I_2$. Because these collector currents are equal to the current flowing through resistor 22, output current I0 is also a function thereof. As the current through resistor 22 is independent to variations in the voltage $V_{cc}$, the current I0 is made to be independent to variations therein also.

It is understood that any number of current sourcing transistors such as transistor 32 could be connected in the same manner as shown for this transistor, whereby multiple output currents could be provided. Moreover, as understood, transistor 32 may have its emitter area ratioed with respect to the emitter area of transistor 12 and 14. Thus, I0 could be any value with respect to the current flowing through resistor 22 and remain independent to power supply voltage ripple variations.

The base currents from transistors 12, 14 and 32 flow between the output of operational amplifier 28 and ground reference and do not appear in the collectors of transistors 18 and 20. Hence, good matching can be obtained between output current I0 and the input currents I1 and I2. This is another feature of the present invention.

Figure 2:
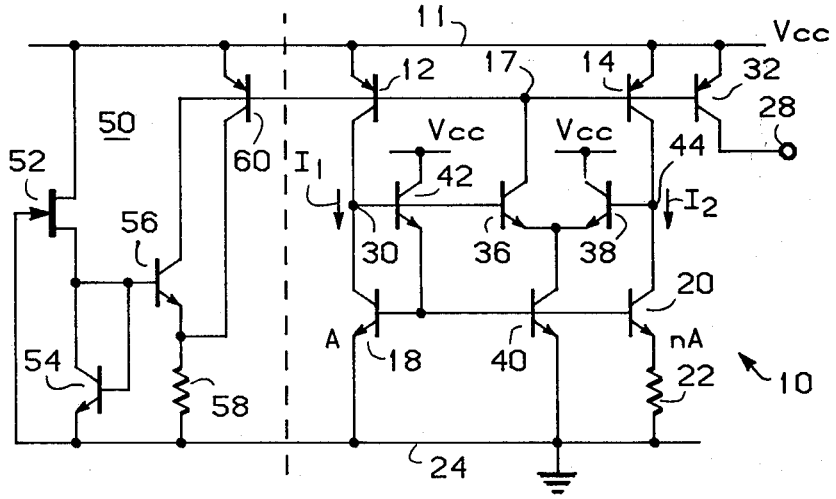
FIG. 2 is a schematic diagram illustrating the current source of the present invention in complete detail.

Turning to FIG. 2 there is shown current source 10 in complete detail. A current start up circuit 50 is illustrated which insures that the circuit becomes functional as input voltage is supplied. Start up circuit 50 includes field effect transistor (FET) 52 with its drain and source coupled in series with the collector-emitter path of transistor 54 which is connected as a diode. The gate electrode of FET 52 is coupled in common with the emitter of transmitter 54 to ground reference. Thus, as the voltage $V_{cc}$ is applied to the circuit, current flows through FET 52 and transistor 54. Transistor 54 and transistor 56 are connected as a current mirror circuit whereby current flowing in the former causes current to flow through the collector-emitter path of the latter and, thus, through resistor 58 to ground reference. A current is thereby caused to be sourced from the base of transistor 60, through transistor 56, to cause this transistor to turn on which in turn forward biases transistor 12, 14 and 32 to insure that they become conductive. Start up circuit 50 continues to function as aforedescribed until the collector current from transistor 60 becomes sufficient to produce a voltage across resistor 58 which reverse biases transistor 56 thereby turning it off. As transistor 56 is turned off start circuit 50 is rendered nonoperative.

Operational amplifier 28 is shown as including differentially connected transistors 36 and 38 having their respective emitters coupled to the collector of transistor 40. Transistor 40 has its emitter return to ground reference and its base connected in common with the bases of transistors 18 and 20. $\Delta V_{be}$ circuit 16 includes transistor 42 for reducing current errors therein as known. The collector of transistor 36 is connected to node 17 and serves as the output of operational amplifier 28.

In operation, as start up circuit 50 renders transistors 12 and 14 conductive, a small current flows from the collector of transistor 12 through transistor 18. This current through transistor 18 causes a current to flow through the collector-emitter path of transistor 20 due to the current mirror action of these two devices. However, transistor 20 wants to conduct a current of value NI1 but since insufficient collector current drive is available thereto, this transistor is driven into a saturated condition at initial turn to drive the voltage level at node 44 low thereby keeping transistor 38 rendered nonconductive.

Current source transistor 40, which is coupled to transistor 20, also tries to source a current I1 therethrough. This causes base current to be pulled from transistors 12, 14 and 32 through the collector-emitter path of transistor 36. A regeneration effect occurs which increases the collector currents of transistors 12, 14, 20, 22 and 40 as additional base current is sourced through transistor 36. This regeneration action continues until such time as the collector current I2, which flows through transistor 20 is equal to value of nI1. Any additional increases in collector currents is prevented as the voltage drop across resistor 22 will reverse bias transistor 20. Hence, at quiescence, the currents I1 and I2 are matched and the voltages appearing at nodes 30 and 44 are made equal and independent to variations in the supply voltage $V_{cc}$. Transistor 32 is thus rendered conductive to supply the current I0 as previously discussed.

I claim:

1. A low voltage precision current source for supplying a current of predetermined value at an output the magnitude of which is substantially independent to ripple variations of a source of operating potential supplied thereto, comprising:

first and second transistors each having first, second and control electrodes, said first electrodes of said first and second transistors being adapted to receive the operating potential;

at least one output transistor having first, second and control electrodes, said first electrode being coupled to said first electrodes of said first and second transistors, said second electrode being coupled to the output of the current source, said control electrode being coupled at a circuit node to said control electrodes of said first and second transistors;

feedback circuit means coupled between said second electrodes of said first and second transistors and said circuit node for maintaining said second electrodes of said first and second transistors at substantially equal voltage potentials independent to ripple variations in the operating potential; and current mirror means coupled to said second electrodes of said first and second transistors for establishing a difference potential which is substantially independent of the voltage potentials appearing at said second electrodes of said first and second transistors, said current mirror means including resistive means across which said difference potential is established and through which a current is produced that is independent to variations in the operating potential, the current supplied at the output of the current source being proportional to said current established through said resistive means.

2. The current source of claim 1 wherein said feedback circuit means includes an operational amplifier having an inverting and a non-inverting input and an output, said inverting input being coupled to said second electrode of said first transistor, said non-inverting input being coupled to said second electrode of said second transistor, said output being coupled to said commonly connected control electrodes of said first and second transistors.

3. The current source of claim 2 wherein said current mirror means includes:

a third transistor having first, second and control electrodes, said first electrode being coupled to a power supply conductor, said second and control electrode being coupled to said second electrode of said first transistor;

a fourth transistor having first, second and control electrodes, said second electrode being coupled to said second electrode of said second transistor, said control electrode being coupled to said control electrode of said third transistor; and said resistive means being connected between said first electrode of said fourth transistor and said power supply conductor.

4. A monolithic integrated precision current source circuit for providing a current at an output thereof the magnitude of which is independent to variations in the magnitude of an operating potential supplied thereto, comprising:

first and second transistors each having first, second and control electrodes, said first electrode being adapted to receive the operating potential, said respective bases being coupled to a circuit node;

at least one output transistor having first, second and control electrodes, said first electrode being adapted to receive said operating potential, said second electrode being coupled to the output of the current source, said base electrode being coupled to said circuit node;

feedback circuit means coupled between said second electrodes of said first and second transistors and said circuit node for maintaining said second electrodes at substantially equal potentials; and a current mirror circuit coupled with said feedback circuit means to said second electrodes of said first and second transistors for producing a difference voltage and a current that is substantially independent of the voltage potentials appearing at said second electrodes of said first and second transistors, the output current of the current source being proportional to said current.

5. The current source of claim 4 wherein said feedback circuit means is an operational amplifier having a non-inverting input coupled to said second electrode of said second transistor, and inverting input coupled to said second electrode of said first transistor and an output coupled to said circuit node.

* * * * *